US008622771B2

(12) United States Patent
Pan

(10) Patent No.: US 8,622,771 B2
(45) Date of Patent: Jan. 7, 2014

(54) ELECTRICAL CONNECTOR HAVING VERSATILE CONTACT MATING SURFACES

(75) Inventor: Feng Pan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 391 days.

(21) Appl. No.: 13/159,454

(22) Filed: Jun. 14, 2011

(65) Prior Publication Data

US 2011/0306249 A1 Dec. 15, 2011

(51) Int. Cl.
*H01R 24/00* (2011.01)

(52) U.S. Cl.
USPC ..... 439/660; 439/884

(58) Field of Classification Search
None
See application file for complete search history.

(56) References Cited

U.S. PATENT DOCUMENTS

| | | | | |
|---|---|---|---|---|
| 7,390,219 | B2 | 6/2008 | Hai | |
| 7,963,806 | B1 * | 6/2011 | Kline et al. | 439/660 |
| 2002/0055286 | A1 * | 5/2002 | MacDougall et al. | 439/108 |

* cited by examiner

*Primary Examiner* — Michael Zarroli
(74) *Attorney, Agent, or Firm* — Ming Chieh Chang; Wei Te Chung

(57) ABSTRACT

An electrical contact (22) includes a first beam (28), a second beam (29), and a receiving cavity (20) defined between the first beam and the second beam. The first beam has a first mating face (281) facing to the receiving cavity, and the second beam has a second mating face (291) facing to the receiving cavity. The first mating face cooperates with the second mating face to form a first mating area to clamp a first area of a mating contact. The first beam has a third mating face (282). The third mating face forms a second mating area facing sidewardly to abut against a second area of a mating contact. The first beam projects sidewardly to form the third mating face.

13 Claims, 5 Drawing Sheets

ELECTRICAL CONNECTOR HAVING VERSATILE CONTACT MATING SURFACES

BACKGROUND OF THE INVENTION

1. Field of the Invention

The present invention relates to an electrical contact and an electrical connector having such electrical contact for communication applications.

2. Description of Related Arts

In communication applications, a header connector and a receptacle connector mating with the header connector are widely used for transmitting high speed signals. Generally, the header connector comprises a plurality of header contacts each having a flat shape, and the receptacle connector comprises a plurality of receptacle contacts each having a bifurcated shape or dual beams for mating with the header contact. There are two mating types between header contacts and receptacle contacts, namely broadside couple and edge couple.

U.S. Pat. No. 7,390,219, issued on Jun. 24, 2008, to Pan discloses a receptacle having edge couple contacts. According to the disclosure, the receptacle comprises a plurality of contacts disposed in a vertical plane. Each of the contacts comprises a bifurcated mating portion defining a mating slot. The bifurcated mating portion comprises a pair of contact surfaces facing to the mating slot for edge coupling with a mating header contact.

The edge-coupling receptacle has no way to provide a broadside couple with the mating connector. Therefore, the applications of the receptacle are restricted Hence, an improved cable connector assembly is desired to offer advantages over the related art.

SUMMARY OF THE INVENTION

An object of the present invention is to provide an electrical contact and an electrical connector having the same that can broadside couple or edge couple with a mating connector.

To achieve the above-mentioned object, an electrical connector comprises a housing, and at least one contact module mounted on the housing. The at least one contact module comprises an insulative body, and a plurality of contacts retained on the insulative body. Each of the contacts has a fork portion extending beyond the insulative body. Each of the fork portions comprises a first beam, a second beam, and a receiving cavity defined between the first and the second beams. The first beam has a first mating face facing to the receiving cavity, and the second beam has a second mating face facing to the receiving cavity. The first mating face cooperates with the second mating face to form a first mating area to clamp a first area of a mating contact. The first beam has a third mating face. The third mating face forms a second mating area facing sidewardly to abut against a second area of a mating contact. The first mating area and the second area are selectively mating with a mating contact.

According to the present invention, an electrical contact comprises a first beam, a second beam, and a receiving cavity defined between the first beam and the second beam. The first beam has a first mating face facing to the receiving cavity, and the second beam has a second mating face facing to the receiving cavity. The first mating face cooperates with the second mating face to form a first mating area to clamp a first area of a mating contact. The first beam has a third mating face. The third mating face forms a second mating area facing sidewardly to abut against a second area of a mating contact.

The first mating area and the second mating area are selectively mating with the different areas of a mating contact.

According to the present invention, the electrical contact and an electrical connector having the same provide a first mating area and a second mating area selectively mating with mating contacts. The first mating area can provide an edge couple, and the second mating area can provide a broadside couple. Therefore, the applications of the electrical contact and the electrical connector having the same are improved.

DETAILED DESCRIPTION OF THE PREFERRED EMBODIMENT

Reference will now be made in detail to a preferred embodiment of the present invention.

Figure 1:
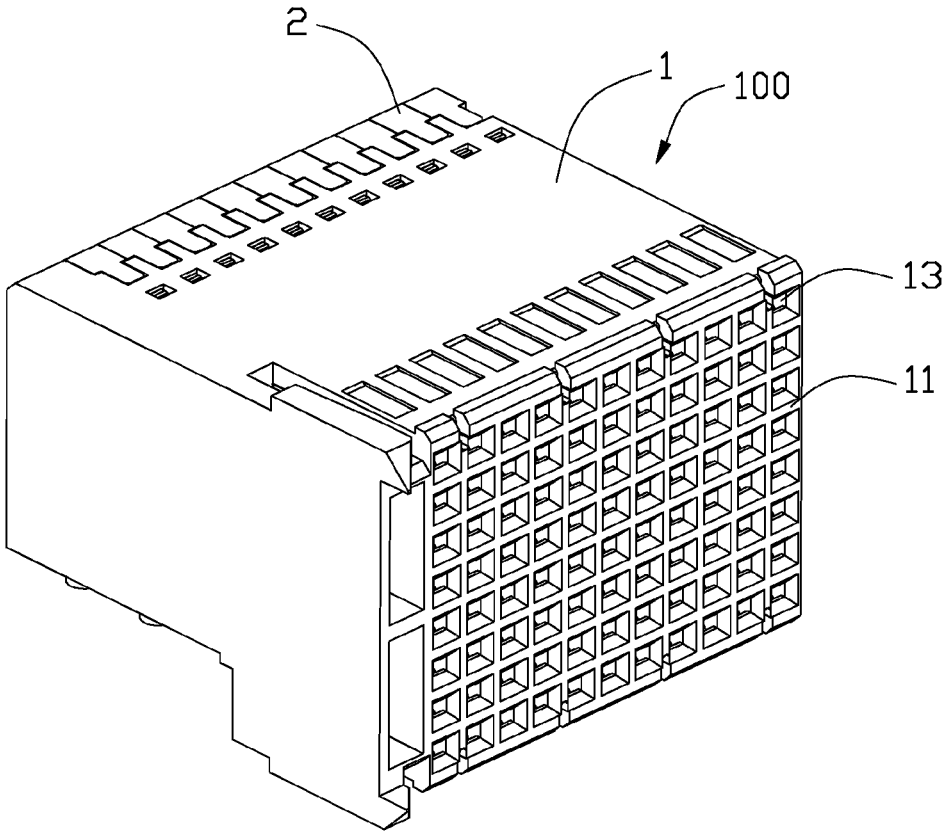
FIG. 1 is a perspective view of an electrically connector in accordance with the present invention.
Figure 2:
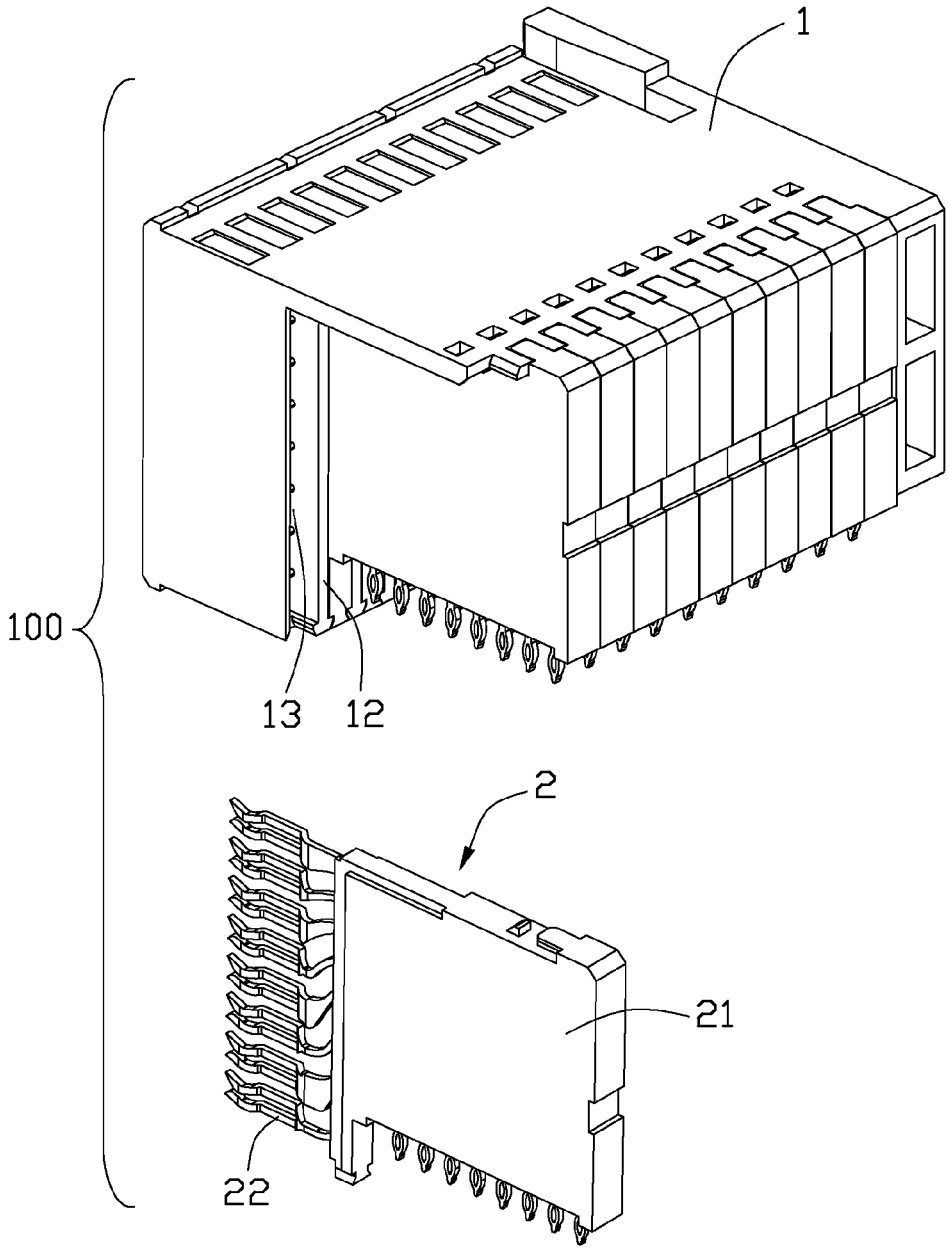
FIG. 2 is a partly exploded view of the electrical connector as shown in FIG. 1.
Figure 3:
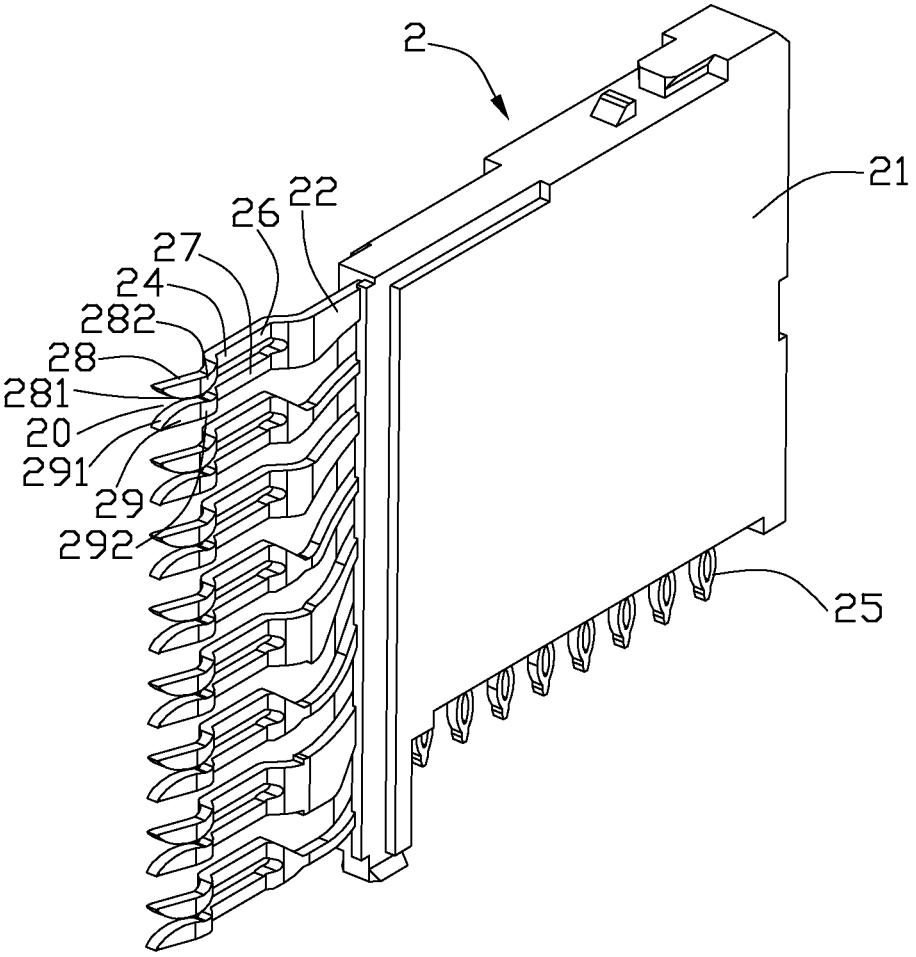
FIG. 3 is a perspective view of a contact module of the electrical connector in accordance with the present invention.

Referring to FIGS. 1 and 2, an electrical connector 100 comprises an insulative housing 1, and a plurality of contact modules 2 arranged side to side and received in the insulative housing 1. The insulative housing 1 comprises a mating face 11, a mounting face 12 opposite to the mating face 11, and a plurality of contact holes 13 through the mating face 11 and the mounting face 12.

The contact modules 2 are mounted to the insulative housing 1 from the mounting face 12 side. Each of the contact module 2 comprises an insulative body 21, and a plurality of contacts 22 assembled, e.g. insert molded, to the insulative body 21. The contacts 22 of each contact module 2 are substantially arranged in a vertical plane. Each of the contacts 22 comprises a middle portion (not shown) embed in the insulative body 21, a fork portion 24 extending forwardly from the middle portion and beyond the insulative body 21, and a tail portion 25 extending downwardly from the middle portion and beyond the insulative body 21. The fork portion 24 comprises a first base 26, a second base 27, a first beam 28 extending forwardly from the first base 26 and projecting to a side direction, and a second beam 29 extending forwardly from the second base 27 and projecting to the side direction. A receiving cavity 20 is formed between a first beam 28 and a corresponding second beam 29 for receiving a contact 3 of a mating connector. A slot 260 is formed between a first base 26 and a corresponding second base 27. The slot 260 has a dimension or height which is larger than the smallest dimension or height of the receiving cavity 20.

Figure 4:
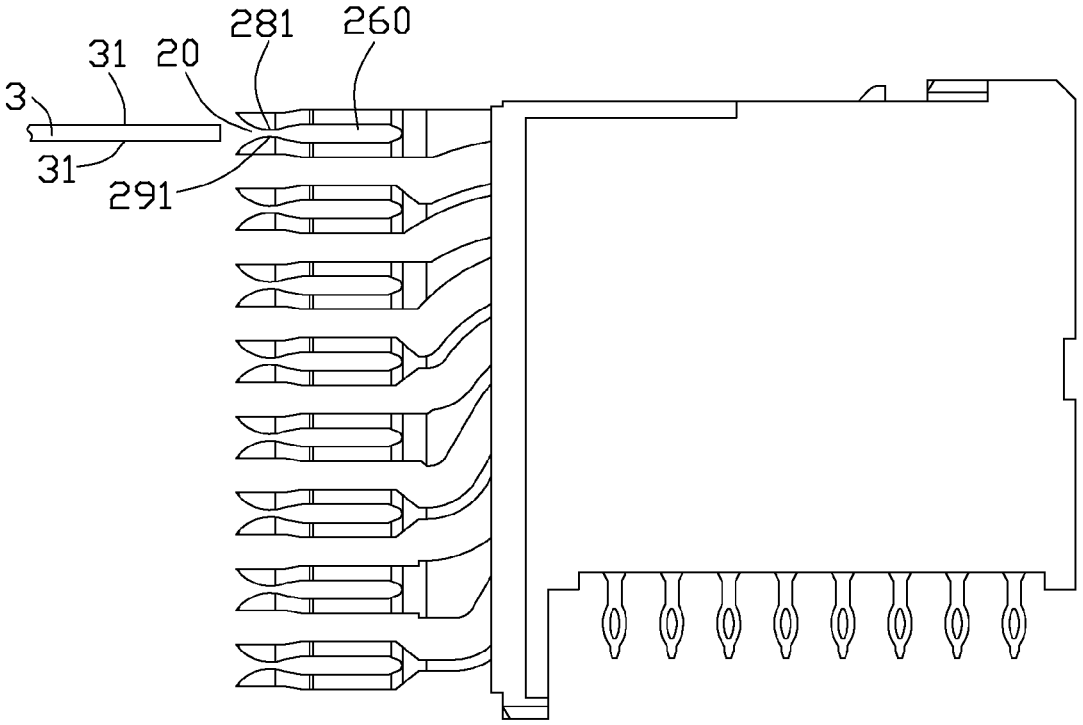
FIG. 4 is a side view of the contact module showing a contact of the contact module edge coupled with a contact of a mating connector.

Referring to FIG. 4, each of the first beams 28 has a first mating face 281 facing to a corresponding receiving cavity 20, and the second beam 29 has a second mating face 291 facing to the receiving cavity 20. The first mating face 281 and the second face 291 are cooperated to form a first mating area. The first and the second mating faces 281, 291 have an arcate shape so that the receiving cavity 20 is enlarged at the free end of the first and the second mating faces 281, 291 for guiding the mating contact 3. The height in vertical direction of the slot 260 is larger than the smallest height of the receiving cavity 20 so that the first surface 31 of the mating contact 3 is stably clamped between the first mating face 281 and the second mating face 291 to achieve an edge couple. The first mating face 281 has a width in horizontal direction not larger than the width of the first beam 28, and the second mating face 291 has a width in horizontal direction not larger than the width of the second beam 29. In this embodiment, the width of the first mating face 281 is equal to the width of the first beam 28, and the width of the second mating face 291 is equal to the width of second beam 29. Therefore, the first beam 28 can directly form the first mating face 281, and the second beam 29 can directly form the second mating face 291, which saves material and simplifies manufacturing.

Figure 5:
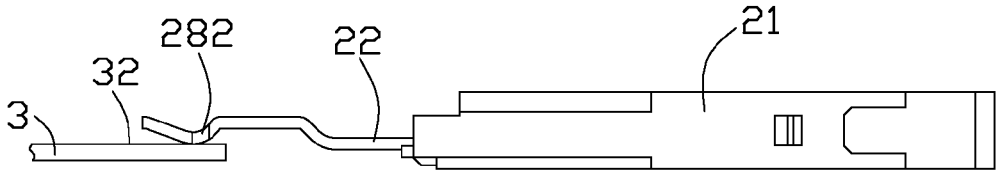
FIG. 5 is a top view of the contact module showing a contact of the contact module broadside coupled with a contact of a mating connector.

Moreover, the first beam 28 comprises a third mating face 282 projecting to a side direction, and the second beam 29 comprises a fourth mating face 292 projecting to the side direction. The third mating face 282 and the fourth mating face 292 are disposed in a common vertical plane to form a second mating area. Referring to FIG. 5, the second mating area abuts against a second surface 32 of the mating contact 3 to achieve a broadside couple. The first surface 31 of the mating contact 3 is perpendicular to the second surface 32 of the mating contact 3. In this embodiment, the second mating area becomes larger since it is formed by the third surface 282 and the fourth surface 292. Optionally, the second mating area also could be formed by one of the third and the fourth mating faces 282, 292.

The first mating area and the second area are selectively mated with the first surface 31 or second surface 32 of the mating contact. Therefore, it is unnecessary to change the structure of the electrical connector 100 to achieve side couple or edge couple. The applications of the electrical connector 100 are versatile.

It is to be understood, however, that even though numerous characteristics and advanarmes of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing; and at least one contact module mounted on the housing, the at least one contact module comprising an insulative body and a plurality of contacts assembled to the insulative body, each of the contacts having a fork portion extending beyond the insulative body, each of the fork portions comprising a first beam, a second beam, and a receiving cavity defined between the first and the second beams;

wherein the first beam has a first mating face facing to the receiving cavity, and the second beam has a second mating face facing to the receiving cavity, wherein the first mating face cooperates with the second mating face to form a first mating area to clamp a first region of a mating contact;

wherein the first beam has a third mating face;

wherein the third mating face forms a second mating area facing sidewardly to abut against a second region of a mating contact;

wherein the first beam projects sidewardly to form the third mating face.

2. The electrical connector as recited in claim 1, wherein the receiving cavity is enlarged at free ends of the first and the second beams for guiding the mating contact.

3. The electrical connector as recited in claim 1, wherein the second beam projects sidewardly to form a fourth mating face, the third and the fourth mating faces cooperated to form the second mating area.

4. The electrical connector as recited in claim 1, wherein the fork portion comprises a first base and a second base, the first beam extending forwardly from the first base and projecting to a side direction, the second beam extending forwardly from the second base and projecting to the side direction.

5. The electrical connector as recited in claim 4, wherein a slot is formed between the first base and the second base, the slot having a height greater than the smallest height of the receiving cavity.

6. The electrical connector as recited in claim 1, wherein the first mating face has a width less than the width of the first beam, and the second mating face has a width less than the width of the second beam.

7. An electrical contact comprising:

a first beam;

a second beam; and a receiving cavity defined between the first beam and the second beam;

wherein the first beam has a first mating face facing to the receiving cavity, and the second beam has a second mating face facing to the receiving cavity;

wherein the first mating face cooperates with the second mating face to form a first mating area to clamp a first region of a mating contact;

wherein the first beam has a third mating face;

wherein the third mating face forms a second mating area facing sidewardly to abut against a second region of a mating contact;

wherein the first beam projects sidewardly to form the third mating face.

8. The electrical contact as recited in claim 7, wherein the first beam projects sidewardly to form said third mating face.

9. The electrical contact as recited in claim 8 wherein the second beam projects sidewardly to form a fourth mating face, the third and the fourth mating faces cooperated to form the second mating area.

10. The electrical contact as recited in claim 9, wherein the receiving cavity is enlarged at free ends of the first and the second beams for guiding the mating contact.

11. An electrical contact arrangement comprising:

first and second beams having common root section while being spaced from each other along a vertical direction in a side view to define a receiving space therebetween in said vertical direction;

said first and second beams defining respectively a pair of projecting configurations in the vertical direction toward each other into said receiving space under condition that said projecting configuration are formed by being directly stamped from sheet metal so as to form a first contact area facing in the vertical direction for allowing a planar section of a mating contact to be sandwiched between the pair of projections and in the receiving space; and said pair of projecting configurations being further commonly sideward projecting, by bending, in a top view so as to commonly form a second contact area facing in a transverse direction for allowing a planar section of another mating contact to abut against the second contact area sideward; wherein the first contact area and the second contact area are defined in two different orientations perpendicular to each other.

12. The electrical contact arrangement as claimed in claim 11, wherein the first and second beams define another sideward projection behind the projecting configuration opposite to said projecting configuration in the top view to enhance resiliency of the first and second beams.

13. The electrical contact arrangement as claimed in claim 11, wherein the first contact area is defined by a thickness dimension of the first and second beams while the second contact area is defined by a planar dimension of the first and second beams.

* * * * *